US008127893B2

(12) United States Patent
Mustalahti et al.

(10) Patent No.: US 8,127,893 B2
(45) Date of Patent: Mar. 6, 2012

(54) ELEVATOR AND ARRANGEMENT

(75) Inventors: Jorma Mustalahti, Hyvinkää (FI); Esko Aulanko, Kerava (FI)

(73) Assignee: Kone Corporation, Helsinki (FI)

( * ) Notice: Subject to any disclaimer, the term of this patent is extended or adjusted under 35 U.S.C. 154(b) by 344 days.

(21) Appl. No.: 11/393,748

(22) Filed: Mar. 31, 2006

(65) Prior Publication Data

US 2006/0196730 A1 Sep. 7, 2006

(30) Foreign Application Priority Data

Nov. 17, 2003 (FI) ..... 20031664
Nov. 24, 2003 (FI) ..... 20031721
Nov. 9, 2004 (WO) ..... 2005/047159

(51) Int. Cl.
*B66B 11/08* (2006.01)
*B66B 11/00* (2006.01)

(52) U.S. Cl. ..... 187/266; 187/251

(58) Field of Classification Search ..... 187/250, 187/251, 254, 264, 266; *B66B 11/08, 9/02, B66B 11/00*

See application file for complete search history.

(56) References Cited

U.S. PATENT DOCUMENTS 912,256 A * 2/1909 Neenan ..... 187/264
988,016 A 3/1911 Neenan
5,398,781 A * 3/1995 Biewald et al. ..... 187/264
5,437,347 A * 8/1995 Biewald et al. ..... 187/264
6,193,017 B1 * 2/2001 Koster ..... 187/258
6,491,136 B2 * 12/2002 Kobayashi et al. ..... 187/254
7,207,421 B2 * 4/2007 Aulanko et al. ..... 187/266

FOREIGN PATENT DOCUMENTS

FR 2823734 A1 * 10/2002
WO WO 98/06655 2/1998
WO WO 2004/041701 11/2003
WO WO 2004094287 A2 * 11/2004
WO WO 2005047159 A2 * 5/2005

* cited by examiner

*Primary Examiner* — Michael Mansen
*Assistant Examiner* — Stefan Kruer
(74) *Attorney, Agent, or Firm* — Harness, Dickey & Pierce, P.L.C.

(57) ABSTRACT

An elevator having an elevator car with a car frame on which are mounted a first set of diverting pulleys from which the hoisting ropes go downwards and a second set of diverting pulleys from which the hoisting ropes go upwards. The rope tension in the rope portions going from the diverting pulleys of the first set is smaller than the rope tension in the rope portions going from the diverting pulleys of the second set by a specified ratio. According to the invention, the diverting pulleys of the first set are at a larger average distance from the car frame than the diverting pulleys of the second set. In a possible inventive arrangement, the distance of an up-direction diverting pulley from the car frame is smaller by a specified ratio than the distance a corresponding down-direction diverting pulley.

20 Claims, 4 Drawing Sheets

ELEVATOR AND ARRANGEMENT

PRIORITY STATEMENT

Figure 1:
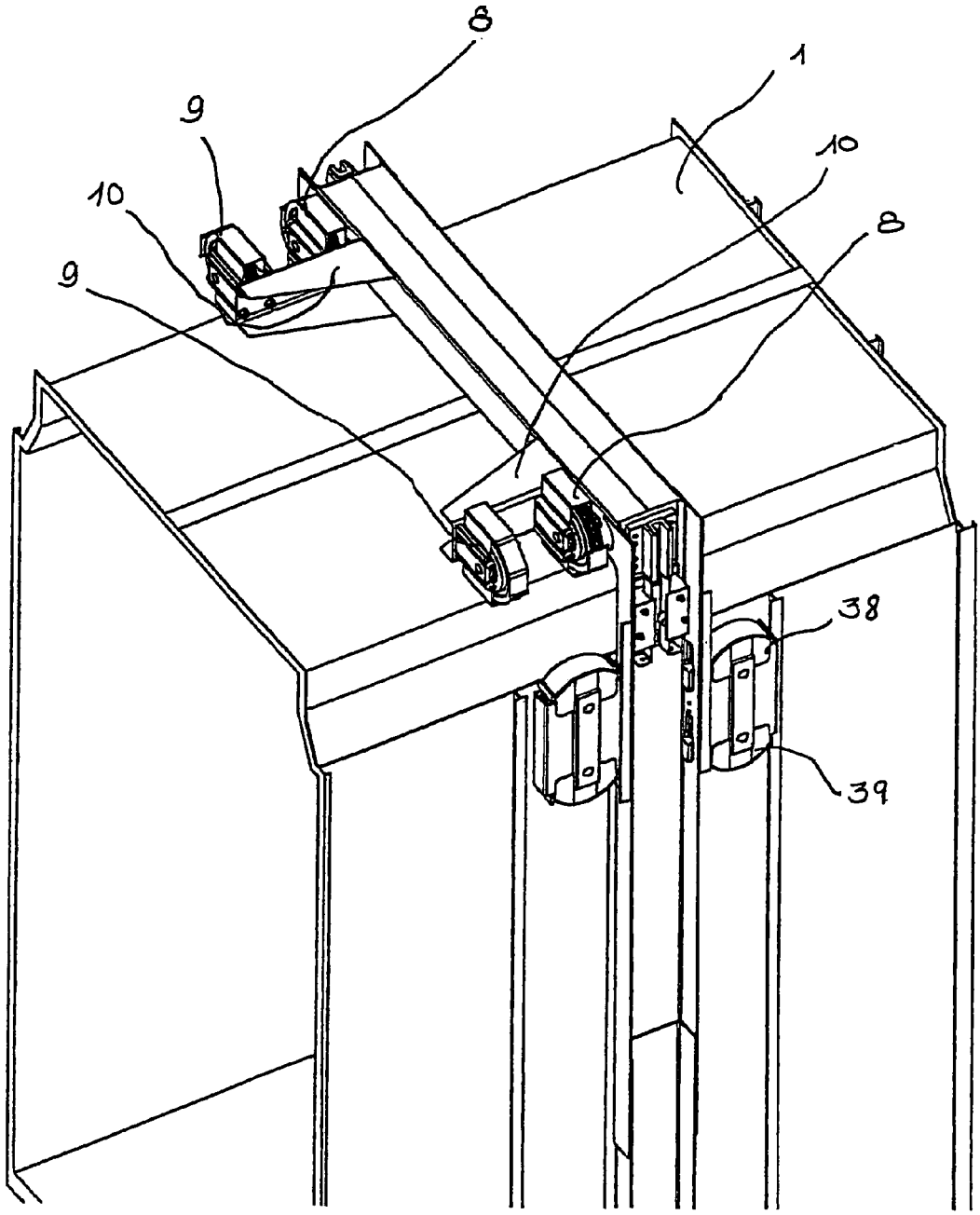

This application is a continuation of International Application No. PCT/FI2004/000660, filed on Nov. 9, 2004 (also known as World Intellectual Property Organization International Publication No. WO 2005/047159 A3), in the Receiving Office of the National Board of Patents and Registration of Finland ("NBPRF"), and claims the benefit of that application under 35 U.S.C. §365(c). In turn, that application claims the right of priority under 35 U.S.C. §365(b) of Finnish Patent Application No. 20031664, filed on Nov. 17, 2003, in the NBPRF, and Finnish Patent Application No. 20031721, filed on Nov. 24, 2003, in the NBPRF.

The present invention relates to elevators and arrangements for elevators.

One of the objectives in elevator development work is to achieve an efficient and economical utilization of building space. In recent years, this development work has produced various elevator solutions without machine room, among other things. Elevators applying these solutions are fairly efficient in respect of space utilization as they have made it possible to eliminate the space needed for the machine room in the building without enlarging the elevator shaft. In these basically good elevator solutions, the space and placement of the hoisting function limits the freedom of choice in elevator lay-out solutions. A major limiting factor is the placement of the counterweight and the space it requires in the elevator shaft. Drum driven elevators, which are nowadays rather seldom installed, have the drawbacks of heavy and complicated hoisting machines and their large power and/or torque requirement. Prior-art elevators without counterweight are exotic and no proper solutions are known. So far it has not been technically or economically reasonable to make elevators without counterweight. One solution like this is disclosed in specification WO9806655. The recent international patent application PCT/FI03/00818 discloses a feasible elevator solution without counterweight that differs from prior-art solutions and uses a large suspension ratio for suspending the elevator car on the hoisting ropes. Creating a traction sheave elevator without counterweight and with a large number of rope portions of hoisting ropes going downwards from the diverting pulleys of the elevator car and rope portions going upwards from the diverting pulleys of the elevator car is a challenging task in respect of roping layout and balancing of the car.

The general aim of the invention is to achieve at least one the following objectives. An objective of the invention is to develop the elevator without machine room so as to achieve more efficient space utilization in the building and in the elevator shaft than before. This means that the elevator should permit of being installed in a relatively narrow elevator shaft if necessary. One objective is to achieve an elevator in which the elevator hoisting rope has a good hold/grip on the traction sheave. A further objective of the invention is to create an elevator solution without counterweight without compromising on the properties of the elevator. It is also an objective of the invention to achieve a more efficient utilization of the elevator shaft spaces above and below the elevator car than before in the case of elevators without counterweight and at the same time to maintain a possibility to work in the elevator shaft. A specific objective is to create an elevator with symmetrical suspension of the elevator car on the hoisting ropes.

The objective or objectives of the invention should be achieved without compromising on the possibility of varying the basic layout of the elevator.

The elevators and arrangements for elevators are discussed below. Inventive embodiments are also presented in the description part of the present application. The inventive content disclosed in the application can also be defined in other ways than is done in the claims below. The inventive content may also consist of several separate inventions, especially if the invention is considered in the light of expressed or implicit sub-tasks or in respect of advantages or sets of advantages achieved. Features of different embodiments and applications of the invention may also be combined in other ways besides those described here. Some of the attributes contained in the claims below may be superfluous from the point of view of separate inventive concepts.

The elevator without counterweight makes efficient use of the cross-sectional area of the shaft, and this efficiency can be improved by reducing the distance between the car wall and the shaft wall. By using an advantages roping solution, the shaft spaces above and below the elevator car can be reduced to a fairly small size. When a high rope transmission ratio is used, the roping can be advantageously made symmetrical or nearly symmetrical relative to the car, thus allowing uncomplicated installation.

Mounted on the car frame of the elevator car of the elevator of the invention are diverting pulleys from which the hoisting ropes go downwards and diverting pulleys from which the hoisting ropes go upwards. The rope tension in the upward rope portions is greater than the rope tension in the downward rope portions. By placing the diverting pulleys for the downward rope portions at a greater average distance from the car frame than the diverting pulleys for the upward rope portions, the tilting moment acting on the car due to the tighter ropes can be compensated, unless the tilting moment can be otherwise handled conveniently by symmetrical disposition of the diverting pulleys. Via suitable placement of just one or two diverting pulleys, it is possible to eliminate the tilting moment. A preferable method is to use an arrangement whereby the tilting moments produced by two diverting pulleys on the car frame cancel each other.

By applying the invention, one or more of the following advantages, among others, can be achieved:

- the invention provides a simple method of implementing a centric suspension of the elevator car of an elevator without counterweight
- in the elevator of the invention, no separate steel structures reducing the shaft space above the elevator car are needed at the upper end of the elevator shaft
- at the lower end of the elevator shaft below the elevator car no space is needed for diverting pulleys or other devices required for suspension, and consequently a shallow pit at the lower end of the elevator shaft will be sufficient
- in the elevator of the invention, no upward or downward rope portions or diverting pulleys are needed in the parts directly above and below the elevator car because the transverse passages of the hoisting ropes take place in conjunction with the elevator car, so the shaft spaces required above and below the elevator can be made shallow
- by applying the invention, efficient utilization of the cross-sectional area of the shaft is achieved
- although the invention is primarily intended for use in elevators without machine room, it can also be applied for use in elevators with machine room, in which case the hoisting ropes have to be passed separately via the hoisting machine in the machine room or the traction sheave of the hoisting machine has to be arranged to be mounted in the elevator shaft Preferable suspension ratios above and below the elevator car are 2:1, 6:1, 10:1 and so on. Other suspension ratios may also be used, e.g. 8:1 or other even ratios. If the end of the hoisting ropes in the rope suspension is secured to the elevator car, the suspension ratio may be an odd ratio, e.g. 7:1 or 9:1.

Symmetrical suspension of the elevator car relative to the elevator car is easily achieved at least in the preferred embodiments of the invention.

installation and maintenance of the diverting pulleys of the elevator are easy to implement as these are secured in place by means of fastening elements.

The primary area of application of the invention is elevators designed for transporting people and/or freight. A normal area of application of the invention is in elevators whose speed range is about or below 1.0 m/s but may also be higher. For example, an elevator traveling at a speed of 0.6 m/s is easy to implement according to the invention.

In the elevator of the invention, normal elevator ropes, such as generally used steel wire ropes, are applicable. The elevator may use ropes of synthetic material and rope structures with a synthetic-fiber load-bearing part, such as e.g. so-called "aramid" ropes, which have recently been proposed for use in elevators. Applicable solutions are also steel-reinforced flat belts, especially because of the small deflection radius they permit. Particularly advantageously applicable for use in the elevator of the invention are elevator hoisting ropes twisted from e.g. round and strong wires. In this way it is possible to achieve thinner ropes and, due to the smaller rope thicknesses, also smaller diverting pulleys and drive sheaves. For example, thin-wired and strong 4-mm ropes can be twisted relatively advantageously from wires such that the average wire thickness in the finished ropes is between 0.15 . . . 0.25 mm, wherein the thinnest wires may have a thickness of only about 0.1 mm.

The elevator of the invention is a traction sheave elevator without counterweight and with an elevator car guided by guide rails and suspended by means of diverting pulleys on a set of hoisting ropes in such manner that that the set of hoisting ropes of the elevator comprises rope portions going upwards and downwards from the elevator car. The elevator comprises a number of diverting pulleys in the upper and lower parts of the elevator shaft. The elevator has a drive machine provided with a traction sheave and placed in the elevator shaft. The elevator comprises a compensating device acting on the hoisting ropes to equalize and/or compensate the rope tension and/or rope elongation. The elevator car has diverting pulleys mounted on it near the two side walls. In the elevator of the invention, the rope portions going from the traction sheave, from the diverting pulleys in the lower part of the elevator shaft and from the diverting pulleys in the upper part of the elevator shaft to the diverting pulleys mounted on the elevator car extend substantially vertically. In the elevator, the rope portions connecting the rope portions extending from one side of the elevator car to the other side are rope portions between diverting pulleys mounted near different side walls of the elevator car.

Figure 2:
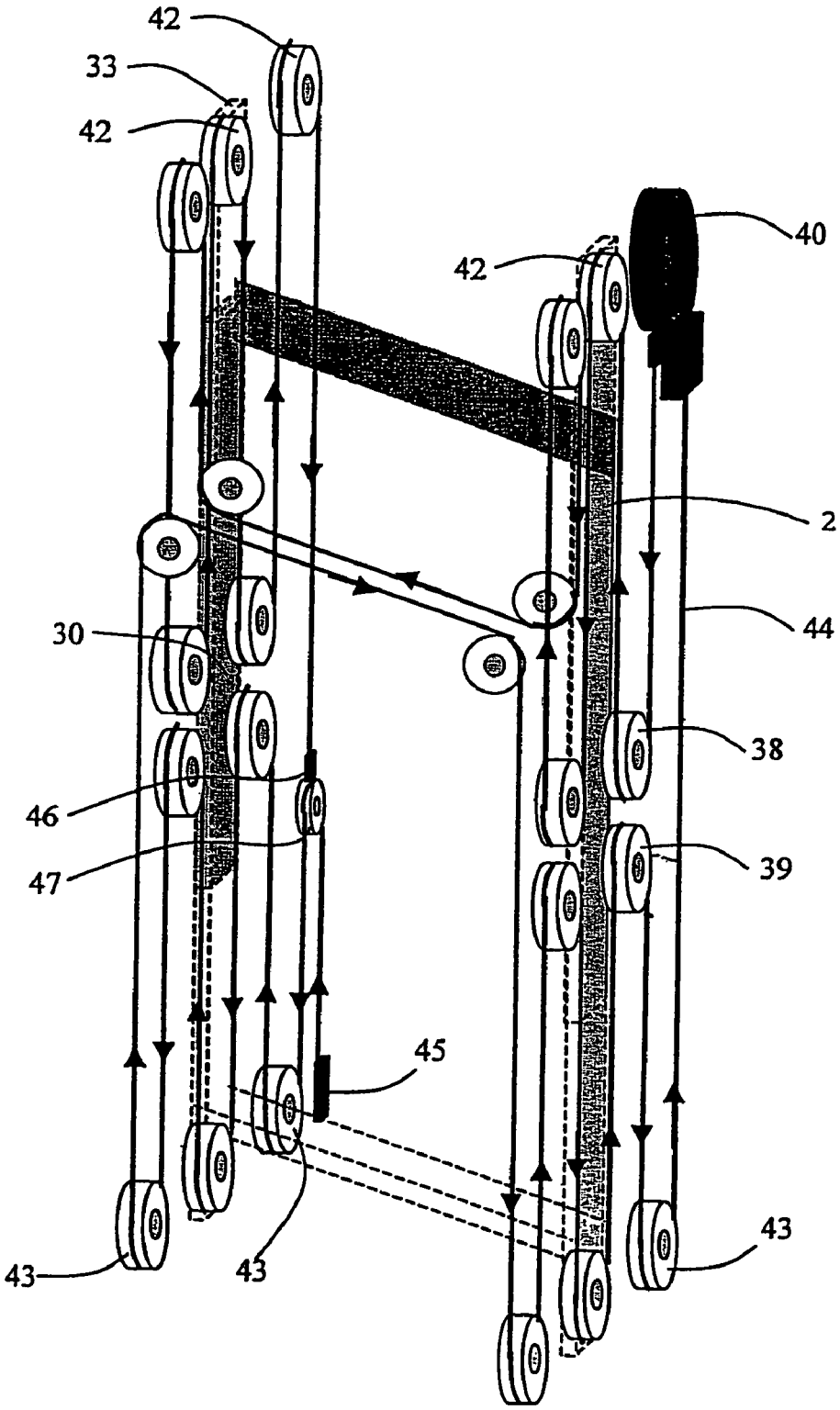

In the following, the invention will be described in detail with reference to a few embodiment examples and the attached drawings, wherein FIG. 1 is a diagram representing the elevator car of an elevator applying the invention, FIG. 2 is a diagram illustrating the rigging of the elevator of the invention.

Figure 3:
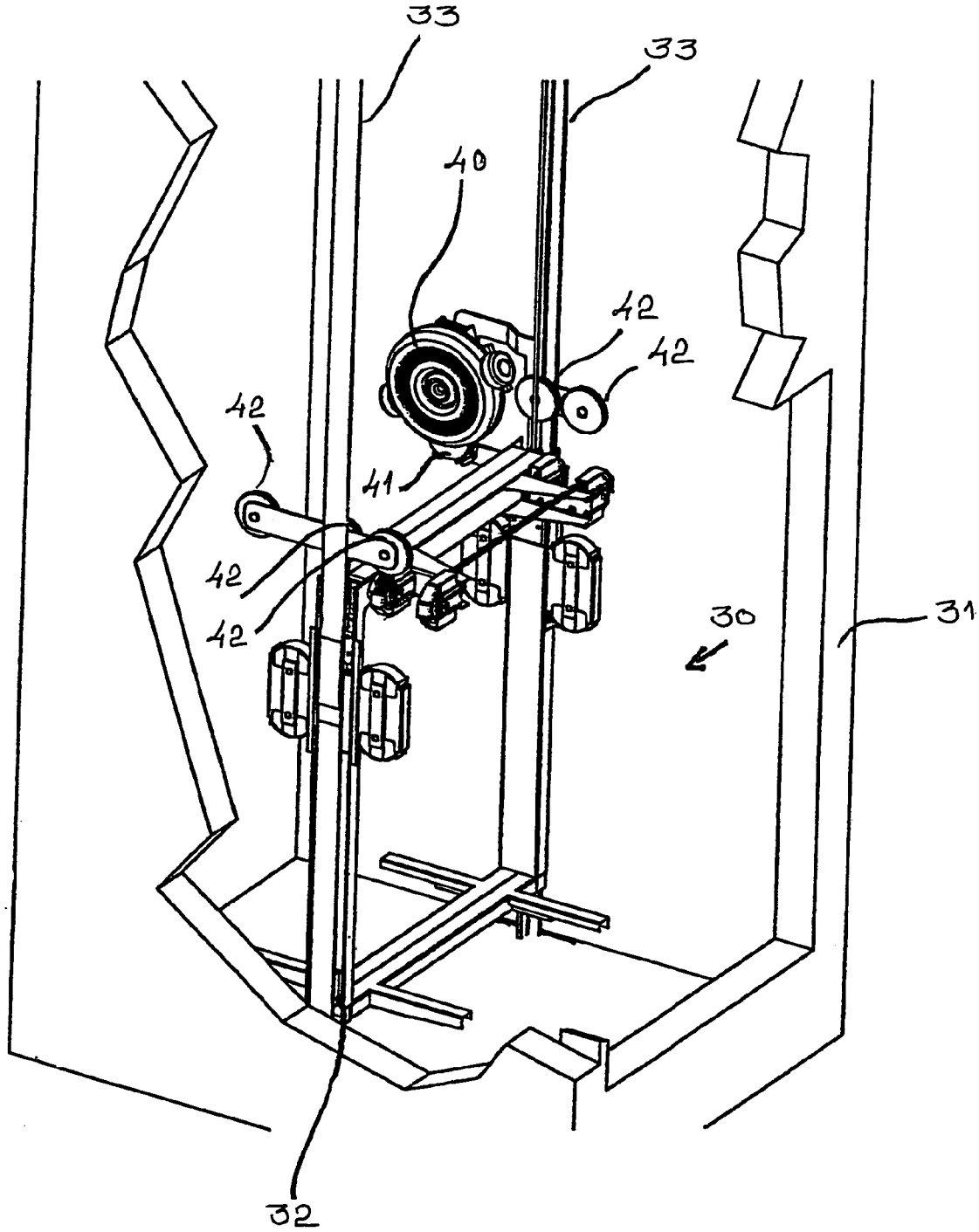
Figure 4:
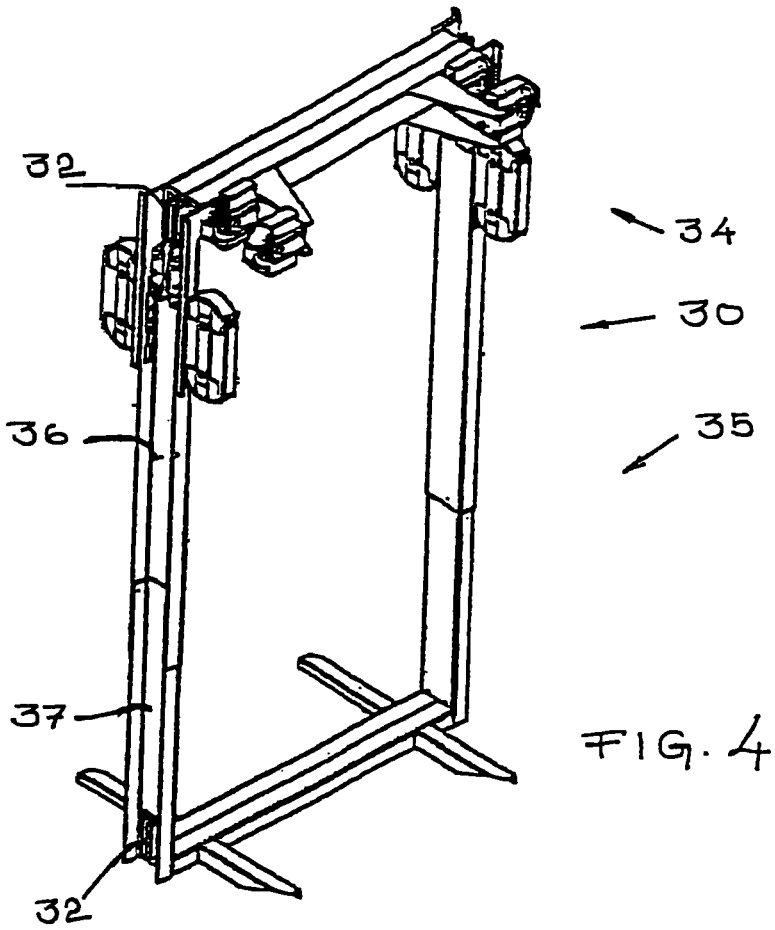
Figure 5:
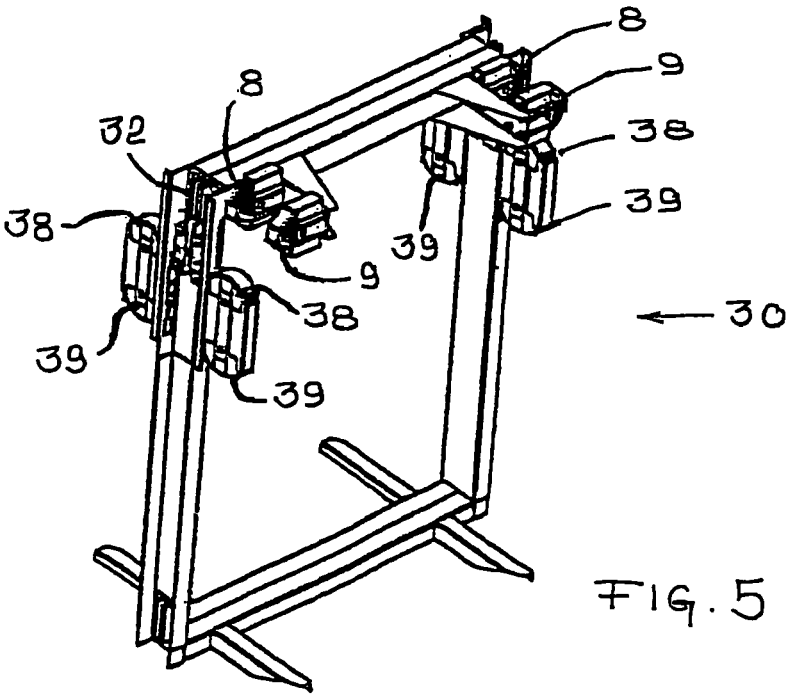

FIG. 3 presents the car supporting frame of the invention on the bottom of the shaft, FIG. 4 presents the car supporting frame of the invention, extended to a height at which the car can be installed in the frame, and FIG. 5 presents the car supporting frame of the invention in a collapsed form.

FIG. 1 presents an elevator car 1 with a car frame. In the figure, the car is shown in a partial view. Placed in the upper part of the car frame are diverting pulleys 9 mounted on the overhead beam to direct the ropes downwards and diverting pulleys 8 mounted on the overhead beam to direct the ropes upwards, the said diverting pulleys belonging to a set of downward-directing diverting pulleys 39 or a set of upward-directing diverting pulleys 38, respectively. The upward- and downward-directing diverting pulleys on the overhead beam are secured to branches 10 of the overhead beam. The placement of the diverting pulley on the branch determines the lever arm from the plane of the car frame at or near which the elevator guides are located. On the other hand, a force proportional to the rope tension is transmitted via the diverting pulleys to the car frame. By adapting the length of the lever arm according to the forces caused by the rope tensions, it is possible to reduce or even eliminate the tilting moment produced by the rope forces and tending to tilt the car.

The edges of the ceiling of the car are beveled in such manner that the ceiling is lower in the vicinity of the side walls of the car. In this way, more efficient utilization of shaft space is achieved as it is possible to place the machine, overspeed governor and/or other shaft equipment at the sides of the upper part of the car, even if there is not enough space for these devices or equipment between the car wall and the shaft wall, or at least to ensure in this way that they have a sufficient distance from the elevator car as required by the safety regulations even in a case where the car is located at the highest possible position.

FIG. 2 is a diagrammatic representation of the roping in an elevator according to the invention. The elevator is preferably an elevator without machine room in which the drive machine 40 is placed in the elevator shaft. The elevator presented in the figures is a traction sheave elevator with machine above and without counterweight in which the elevator car 1 moves along guide rails 2.

FIG. 2 shows how the ropes in an elevator implemented according to the invention are passed over different diverting pulleys and the rope wheels of the drive machine 40, and FIGS. 3, 4, and 5 show the car-supporting frame 30, which in FIG. 4 is presented in a length that allows the elevator car 1 to be installed inside the car-supporting frame 30 and in FIG. 5 in collapsed or low form allowing easy transportation of the car-supporting frame 30, as far as the car-supporting frame 30 is transported as a complete assembly, with diverting pulleys mounted on it, allowing the set of hoisting ropes 44 to be easily passed to them when the car-supporting frame 30 is on the bottom of the elevator shaft 31 as illustrated in FIG. 3. The car-supporting frame 30 is provided with guides 32, by means of which the elevator car 1 is positioned and controlled as it is moving vertically along the elevator guide rails 33. The upper part 34 and the lower part 35 of the car-supporting frame 30 are telescopically joined together by beam sections 36 and 37 of the side beams of the car-supporting frame 30, the beam sections 36 and 37 being insertable into each other. The telescopic or otherwise variable-length joining together of the upper part 34 and the lower part 35 can also be implemented in other ways. The car-supporting frame 30 is provided with diverting pulleys intended for the suspension of the elevator car 1 on the set of hoisting ropes 44, comprising a first set of diverting pulleys 38, from which the ropes of the set of hoisting ropes 44 go upwards, and a second set of diverting pulleys 39, from which the ropes of the set of hoisting ropes 44 go downwards. FIG. 3 shows the diverting pulleys 42 to be installed in the upper part of the elevator shaft 31, but that are temporarily mounted on the car-supporting frame 30, the drive machine 40 with a traction sheave (not shown) and preferably an auxiliary diverting pulley 41, that allows the roping on the drive machine 40 to be implemented as so-called Double Wrap roping or the contact angle between the traction sheave and the set of hoisting ropes 44 to be changed in other ways. In FIG. 2, the set of hoisting ropes 44 is depicted as a single rope with arrowheads indicating the passage of the rope, starting from the rope end fixing point 45 in the lower part of the elevator shaft 31 and finally ending up at a rope force differentiating arrangement 46, that consists of a tackle system 47 designed to maintain the relative rope tension difference between the rope portions above and below the elevator car 1. The rope force differentiating arrangement 46 can also be implemented in other ways that may involve a different solution regarding the fixing of the rope ends. Starting from the rope end fixing point 45, the set of hoisting ropes 44 goes first to a rope wheel comprised in the rope force differentiating arrangement 46, then continues to the diverting pulley 43 in the lower part of the elevator shaft 31, from where the set of hoisting ropes 44 goes further to a down-direction diverting pulley 39 on the elevator car 1 and further, passes one-by-one over the diverting pulleys in the lower part of the elevator shaft 31 and the down-direction diverting pulleys of the elevator car 1, until from the last diverting pulley in the lower part of the elevator shaft 31, the set of hoisting ropes 44 goes up to the drive machine 40. From the drive machine 40, the set of hoisting ropes 44 runs further to the first up-direction diverting pulley 38 on the elevator car 1, passes by turns over the diverting pulleys 42 in the upper part of the elevator shaft 31 and each up-direction diverting pulley 38 on the elevator car 1, until from the last diverting pulley in the upper part of the elevator shaft 31, the set of hoisting ropes 44 terminates at the rope force differentiating arrangement 46.

It is obvious to the person skilled in the art that different embodiments of the invention are not limited to the examples described above, but that they may be varied within the scope of the claims presented below. For example, the number of times the hoisting ropes are passed between the diverting pulleys in the upper part of the elevator shaft and those on the elevator car and between the diverting pulleys in the lower part of the elevator shaft and those on the elevator car is not a very decisive question as regards the basic advantages of the invention, although it is possible to achieve some additional advantages by using multiple and even numbers of rope portions. It is also obvious to the skilled person that an embodiment according to the invention can also be implemented using odd suspension ratios above and below the elevator car, in which case the compensating device is mounted in conjunction with the elevator car or its structures. In accordance with the examples described above, a skilled person can vary the embodiment of the invention as the traction sheaves and rope pulleys, instead of being coated metal pulleys, may also be uncoated metal pulleys or uncoated pulleys made of some other material suited to the purpose.

It is also obvious to the person skilled in the art that the elevator car and the machine unit may be laid out in the cross-section of the elevator shaft in a manner differing from the lay-out described in the examples. The skilled person also understands that 'elevator car' may refer to a self-supporting car structure, an assembly consisting of an elevator car and a car supporting frame, or also a car structure mounted inside a car supporting frame.

It is obvious to the skilled person that an elevator applying the invention may be equipped differently from the examples described above. It is further obvious to the skilled person that the elevator of the invention can be implemented using as hoisting ropes almost any flexible hoisting means, e.g. a flexible rope of one or more strands, a flat belt, a cogged belt, a trapezoidal belt or some other type of belt suited to the purpose.

It is further obvious to the skilled person that the elevator of the invention may also be provided with a counterweight, in which case the counterweight of the elevator preferably has a weight below that of the car and is suspended by a separate set of ropes. The skilled person understands that an elevator shaft is not strictly necessary for the elevator, provided that sufficient safety and protection of the technical parts are achieved.

The invention claimed is:

1. An elevator, comprising:

an elevator car;

a car-supporting frame supporting the elevator car, the car-supporting frame having guide devices and a horizontal beam above the elevator car, the horizontal beam extending between the guide devices, and the guide devices being configured to guide the elevator car along guide rails;

a first set of diverting pulleys on the horizontal beam;

a second set of diverting pulleys on the horizontal beam; and a set of hoisting ropes;

wherein the hoisting ropes go downward from each diverting pulley of the first set of diverting pulleys, wherein the hoisting ropes go upward from each diverting pulley of the second set of diverting pulleys, wherein a first rope tension in rope portions of the hoisting ropes going downward from each diverting pulley of the first set of diverting pulleys is smaller than a second rope tension in rope portions of the hoisting ropes going upward from each diverting pulley of the second set of diverting pulleys by a specified ratio, and wherein a first average distance, measured from a vertical plane of the car-supporting frame to all of the diverting pulleys of the first set of diverting pulleys, is larger than a second average distance, measured from the vertical plane of the car-supporting frame to all of the diverting pulleys of the second set of diverting pulleys.

2. The elevator of claim 1, wherein at least one diverting pulley of the first set of diverting pulleys is at a larger distance from the vertical plane of the car-supporting frame than any one of the diverting pulleys of the second set of diverting pulleys.

3. The elevator of claim 1, wherein all of the diverting pulleys of the first set of diverting pulleys are disposed symmetrically on same sides of the elevator car as the guide rails.

4. The elevator of claim 1, further comprising:

wherein all of the diverting pulleys of the second set of diverting pulleys are disposed symmetrically on same sides of the elevator car as the guide rails.

5. The elevator of claim 1, wherein the elevator uses an even suspension ratio above the elevator car.

6. The elevator of claim 1, wherein the elevator uses an even suspension ratio below the elevator car.

7. The elevator of claim 1, wherein the elevator is without machine room.

8. The elevator of claim 1, wherein the elevator is without counterweight.

9. The elevator of claim 1, further comprising:

at least one bracket;

wherein the at least one bracket is configured to support at least one of the diverting pulleys of the first set of diverting pulleys.

10. The elevator of claim 1, further comprising:

at least one bracket;

wherein the at least one bracket is configured to support at least one of the diverting pulleys of the second set of diverting pulleys.

11. The elevator of claim 1, further comprising:

wherein all of the diverting pulleys of the first set of diverting pulleys are disposed on same sides of the elevator car as the guide rails, and wherein all of the diverting pulleys of the second set of diverting pulleys are disposed on the same sides of the elevator car as the guide rails.

12. An arrangement for an elevator, wherein the elevator includes an elevator car, a car-supporting frame supporting the elevator car and having guide devices and a horizontal beam, which is above the elevator car and extends between the guide devices, the guide devices being configured to guide the elevator car along guide rails, the elevator further including a first set of diverting pulleys on the horizontal beam from which hoisting ropes of the elevator go downward, and a second set of diverting pulleys on the horizontal beam from which the hoisting ropes of the elevator go upward, the arrangement comprising:

a first rope tension in rope portions of the hoisting ropes going downward from each diverting pulley of the first set of diverting pulleys that is smaller than a second rope tension in rope portions of the hoisting ropes going upward from each diverting pulley of the second set of diverting pulleys;

a first average distance measured from a vertical plane of the car-supporting frame to all of the diverting pulleys of the first set of diverting pulleys; and a second average distance measured from the vertical plane of the car-supporting frame to all of the diverting pulleys of the second set of diverting pulleys;

wherein a ratio of the first rope tension to the second rope tension is substantially equal to a ratio of the second average distance to the first average distance.

13. The arrangement of claim 12, further comprising:

at least one bracket;

wherein the at least one bracket is configured to support at least one of the diverting pulleys of the first set of diverting pulleys.

14. The arrangement of claim 12, wherein the second rope tension is at least twice as great as the first rope tension.

15. The arrangement of claim 12, wherein a tilting moment of the hoisting ropes acting on the car frame is about zero.

16. The arrangement of claim 12, further comprising:

at least one bracket;

wherein the at least one bracket is configured to support at least one of the diverting pulleys of the second set of diverting pulleys.

17. The arrangement of claim 12, wherein the arrangement uses an even suspension ratio above the elevator car.

18. The arrangement of claim 12, wherein the arrangement uses an even suspension ratio below the elevator car.

19. The arrangement of claim 12, wherein the elevator is without machine room.

20. The arrangement of claim 12, wherein the elevator is without counterweight.

* * * * *